US005308001A

United States Patent [19]

Grecksch et al.

[11] Patent Number: 5,308,001

[45] Date of Patent: May 3, 1994

[54] TRANSPORT SYSTEM FOR CIRCULATING AND ACCUMULATING TUBE SUPPORT MEMBERS IN ASSOCIATION WITH A BOBBIN WINDING MACHINE

[75] Inventors: Hans Grecksch, Mönchengladbach; Jürgen Backhaus, Wegberg, both of Fed. Rep. of Germany

[73] Assignee: W. Schlafhorst AG & Co., Moenchengladbach, Fed. Rep. of Germany

[21] Appl. No.: 994,110

[22] Filed: Dec. 21, 1992

[30] Foreign Application Priority Data

Dec. 21, 1991 [DE] Fed. Rep. of Germany ..... 4142621

[51] Int. Cl.[5] ..... B65H 67/06

[52] U.S. Cl. ..... 242/35.5 A; 198/347.4

[58] Field of Search ..... 242/35.5 A, 35.5 R, 242/35.6 R, 18 R; 198/347.4

[56] References Cited

U.S. PATENT DOCUMENTS 3,118,549 1/1964 Hoellen ..... 198/347.4
3,122,231 2/1964 Pence et al. ..... 198/347.4
5,056,725 10/1991 Wirtz et al. ..... 242/35.5 A
5,092,531 3/1992 Grecksch et al. ..... 242/35.5 A
5,170,954 12/1992 Derichs ..... 242/35.5 A

*Primary Examiner*—Stanley N. Gilreath
*Attorney, Agent, or Firm*—Shefte, Pinckney & Sawyer

[57] ABSTRACT

A transport system for circulating bobbin tube support members from and to a textile winder includes conveyors for conveying bobbin tube support members from and to a textile winder, a plurality of mutually independently controllable accumulating devices disposed intermediate the conveyors for conveying tube support members from and to the textile winder, and an overflow conveyor for conveying loaded support members to the accumulating devices. A position detecting arrangement provides information to a central control device regarding the number and location of tube support members within the transport system and a series of diverting and retaining gates are provided to control the movement of tube support members within the transport system, particularly the delivery of tube support members to and from the accumulating devices depending on the demand of the winder and the speed of the bobbin loading operation.

26 Claims, 3 Drawing Sheets

TRANSPORT SYSTEM FOR CIRCULATING AND ACCUMULATING TUBE SUPPORT MEMBERS IN ASSOCIATION WITH A BOBBIN WINDING MACHINE

BACKGROUND OF THE INVENTION

The present invention relates generally to a transport system for circulating and accumulating tube support members in association with a bobbin winding machine.

The feeding of bobbins of yarn to textile winding machines and the removal of empty bobbin tubes from the winding machines has been automated by the use of independent bobbin tube support members circulated to and from the winding machines by transport systems that transport empty bobbin tubes from the winding machine for replacement of the empty tubes with full bobbin tubes on the tube support members and transport the tube support members with full bobbin tubes back to the winding machine.

To accommodate various processing operations, such as the removal of empty tubes from the tube support members and the mounting of full bobbins on the tube support members as well as other optional operations, and to maintain a ready supply of full bobbins to maintain the winding machine in continuous operation without interruption, it is necessary to provide for an accumulation of tube support members in the transport system. This is particularly advantageous when the placement of full bobbins on the tube support members can be accomplished at a greater rate than the demand of the winding machine for bobbins. For example, normally full bobbins can be loaded on tube support members manually faster than the demand of the machine for bobbins such that an operator could intermittently load bobbins at more than one machine or perform other tasks between loadings provided there were some means of accumulating loaded bobbin tube support members between loading and delivery to the winding machine. Some accumulation is provided by the length of the path of the transport system from the loading station to the station at which the full bobbins are delivered to the winding machine, but sufficient length to accumulate a full supply of bobbins, particularly for large capacity winding machines, is not practical because of the excessive floor space required.

SUMMARY OF THE INVENTION

It is accordingly the object of the present invention to provide a transport system that incorporates an accumulating apparatus of practical form and function and capable of high capacity in combination with a loading station so that the loading of a full supply of bobbins can be performed intermittently and the full bobbins accumulated for delivery to the winding machine in response to demand.

According to the preferred embodiment of the present invention, a transport system for circulating bobbin tube support members from and to a textile winder includes an assembly for conveying bobbin tube support members from the textile winder, an assembly for conveying bobbin tube support members to the textile winder, an arrangement for temporarily accumulating bobbin tube support members intermediate the assembly for conveying tube support members to and from the textile winder, and a control arrangement for selectively controlling the receipt and release of tube support members to and from the individual accumulating devices.

It is preferred that the accumulating arrangement include an inlet conveying assembly for receiving tube support members from the assembly for conveying bobbin tube support members from the textile winder, an outlet conveying assembly for delivering tube support members to the assembly for conveying bobbin tube support members to the winder and a plurality of individual tube support member accumulating devices intermediate the inlet and outlet conveying assemblies for selectively receiving tube support members from the inlet conveying assembly, accumulating tube support members thereon, and releasing the tube support members to the outlet conveying assembly. It is preferred that the control arrangement direct support members having bobbin tubes disposed thereon and empty tube support members to different of said individual accumulating devices.

The control arrangement includes a central control device and a diverting arrangement operable by the central control device and associated with each said accumulating device at the inlet conveying assembly and the outlet conveying assembly for controlling the receipt and discharge of the tube support members to and from the accumulating devices. It is preferred that the diverting arrangement include a plurality of remotely actuable gates, including gates disposed for diverting tube support members from the inlet conveying assembly to selected accumulating devices and gates disposed for selectively retaining tube support members on the accumulating devices or releasing tube support members from the accumulating devices to the outlet conveying assembly.

A bobbin tube loading station is provided and preferably disposed along the assembly for conveying tube support members to the textile winder intermediate the outlet conveying assembly and the textile winder at which bobbin tubes may be loaded onto empty tube support members being conveyed on the assembly for conveying bobbin tube support members to the winder. A retaining gate is disposed adjacent the loading station actuable to selectively retain tube support members at the loading station.

Preferably, the transport assembly of the present invention includes an overflow conveying assembly disposed for receiving tube support members from the assembly for conveying tube support members to the textile winder and an overflow diverting gate disposed for diverting tube support members being conveyed on the assembly for conveying tube support members to the textile winder to said overflow conveying assembly, the overflow diverting gate being in communication with the central control device. Further, the overflow conveying assembly includes an overflow detecting arrangement for detecting tube support members diverted to the overflow conveying assembly and communicating with the central control device. The overflow conveying assembly is disposed for delivering tube support members to the assembly for conveying tube support members from the textile winder. Additionally, the overflow conveying assembly includes an overflow retaining gate disposed for retaining tube support members on the overflow conveying assembly, the gate being in communication with the central control device and actuable in response to information received therefrom.

Preferably, each individual accumulating device is disposed for receiving tube support members from the inlet conveying assembly and the control arrangement includes a detecting arrangement disposed for detecting tube support members received by each accumulating device from the inlet conveying assembly and released by each accumulating device to the outlet conveying assembly and communicating with the control arrangement.

The accumulating devices are arranged in a series and the inlet conveying assembly communicates with each accumulating device in the series with the control arrangement diverting the diverting means to fill the accumulating devices with tube support members having bobbin tubes disposed thereon sequentially from one side of the series and to fill accumulating devices with empty tube support members from the other side of the series.

It is further preferred that the transport system of the present invention include a first retaining gate disposed along the assembly for conveying tube support members to the textile winder intermediate the overflow conveying assembly and the textile winder for selectively retaining and releasing tube support members on the assembly for conveying tube support members to the textile winder. Additionally, a first detecting arrangement is disposed intermediate the first retaining gate and the textile winder for counting and detecting tube support members entering the textile winder and communicating with the central control device for actuating the first retaining gate responsive to the first detecting arrangement detecting and the central control device counting, a selective predetermined number of tube support members entering the textile winder. A first retainer detecting arrangement is provided for detecting tube support members retained by the first retaining gate and is disposed intermediate the overflow conveying assembly and the first retaining gate, the detecting arrangement being in communication with the central control device and the diverting gate that is disposed at the inlet to the overflow conveying arrangement being selectively actuable by the central control device to divert tube support members to the overflow conveying assembly in response to information from the first retaining gate that the first retaining gate is positioned for retaining tube support members and from the first retainer detecting arrangement that the portion of the assembly for conveying tube support members to the textile winder intermediate the first retaining gate and the first retainer detecting arrangement includes a predetermined maximum number of tube support members.

Preferably, a second retaining gate is disposed along the assembly for conveying tube support members to the textile winder intermediate the outlet conveying assembly and the overflow conveying assembly and is actuable by the control arrangement to selectively retain and release tube support members on the assembly for conveying tube support members to the bobbin winder in response to the overflow detecting arrangement detecting and the central control device counting, a selective predetermined number of support members disposed on the overflow conveying assembly and the first retainer detecting arrangement detecting a selective, predetermined number of support members contained intermediate the first retaining gate and the first retainer detecting arrangement. In addition, a second retainer detecting arrangement is disposed along the assembly for conveying tube support members to the textile winder intermediate the overflow conveying assembly and the outlet conveying assembly for detecting tube support members retained and released by the second retaining gate, the second retainer detecting arrangement being in communication with the central control device for controlling the actuation of the second retaining gate. Preferably, the overflow conveying assembly is disposed for releasing tube support members to the assembly for conveying tube support members from the textile winder intermediate the textile winder and the inlet conveying assembly.

According to a second preferred embodiment of the present invention, the overflow conveying assembly is disposed at an end of and substantially aligned with the inlet conveying assembly and the overflow conveying assembly and the inlet conveying assembly are each individually selectively reversible for conveying movement of tube support members at either direction responsive to instructions from the central control device.

Preferably, the overflow conveying assembly is operable for delivery of tube support members to and from the inlet conveying assembly. Further, a retaining gate is disposed for retaining tube support members on the overflow conveying assembly and a second retaining gate is disposed for retaining tube support members on the assembly for conveying tube support members from the textile winder, each of the retaining gates being in communication with and individually actuable by the central control device to selectively direct tube support members onto the inlet conveying assembly from either of the overflow conveying means and the means for conveying tube support members from the textile winder, the central control device actuating driving movement of the reversible inlet conveying assembly in a direction responsive to one of the retaining gates being open for movement of tube support members away therefrom.

According to a third preferred embodiment of the present invention, the overflow conveying arrangement is an extension of the inlet conveying arrangement and includes a retaining gate disposed therealong for selectively retaining and releasing tube support members and the assembly for conveying tube support members from the textile winder communicates with the inlet conveying assembly at a location adjacent the overflow conveying assembly.

The present invention further includes a tube doffer disposed along the assembly for conveying tube support members from the textile winder intermediate the textile winder and the overflow conveying assembly for removing bobbin tubes from the support members.

Additionally, a retaining gate is disposed along the assembly for conveying tube support members from the textile winder intermediate the inlet conveying assembly and the tube doffer for selectively retaining and releasing tube support members on the assembly for conveying tube support members from the textile winder. Further, a detecting arrangement is included for detecting tube support members retained or released by the retaining gate, the detecting arrangement including a first detector being disposed along the assembly for conveying tube support members from the textile winder adjacent the retaining gate and being intermediate the inlet conveying assembly and the overflow conveying assembly and a second detector disposed intermediate the overflow conveying assembly and the tube doffer each of the detectors being in communication with the central control device.

The overflow retaining gate and the retaining gate disposed along the assembly for conveying tube support members from the textile winder are each individually actuable by the central control device, the actuation of one of the gates acting to prevent the actuation of the other of the gates to prevent the mixing of tube support members received from the overflow conveying assembly and tube support members received from the textile winder.

DESCRIPTION OF THE PREFERRED EMBODIMENTS

The three preferred em of the transport system for circulating bobbin tube support members of the present invention are illustrated in the accompanying three drawings. In each of these embodiments means for temporarily accumulating bobbin tube support members is provided for accumulating empty tube support members received from the associated spinning machine preparatory to loading them with full bobbins and also accumulating loaded tube support members preparatory to their being fed to the associated spinning machine. Thus, the loading of full bobbins onto empty tube support members does not need to be synchronized with the receipt or feed of tube support members from and to the spinning machine. Rather, full bobbins can be periodically loaded at a fast rate for subsequent feed to the spinning machine as demanded. For example, an operator or an automatic loader can service more than one spinning machine supply or can perform other tasks intermediate the periodic loading operation.

In each embodiment the tube support member transport system is formed by a network of endless belt conveyors of conventional design and operation that are driven in the directions indicated by the arrows in each of the figures, with one conveyor serving as means for conveying bobbin tube support members from the textile winder (not shown) and another conveyor serving as means for conveying bobbin tube support members to the textile winder. Means are incorporated in each of the embodiments in the form of a plurality of devices, which in the preferred embodiments of the figures are also conventional endless belt conveyors, for temporarily accumulating empty bobbin tube support members received from the winding machine and accumulating support members with full bobbins received from a loading station.

Figure 1:
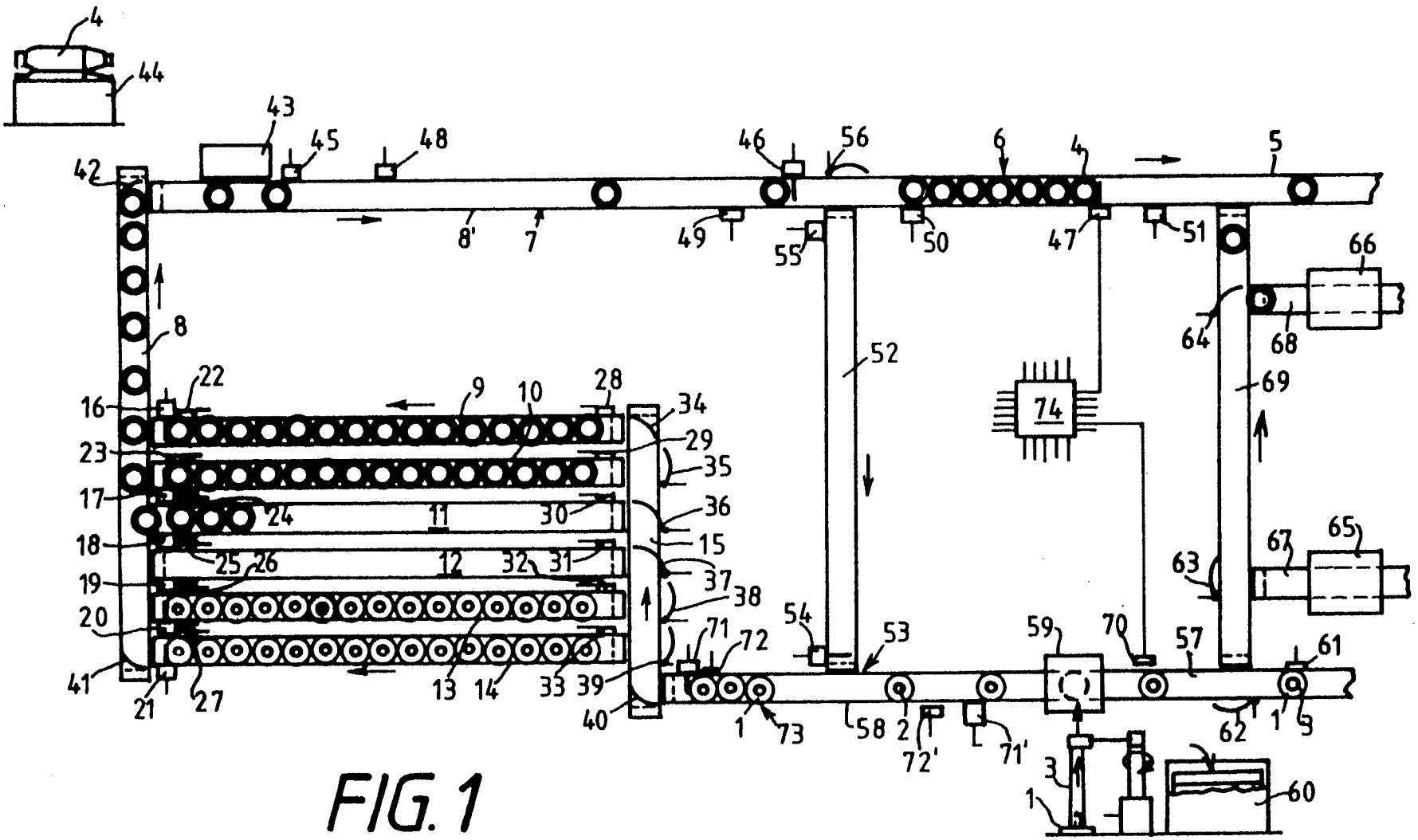
FIG. 1 is a schematic top plan view of a transport system incorporating an accumulating apparatus according to one preferred embodiment of the present invention.

Referring specifically to the embodiment of FIG. 1, the conveyor 57,58 from the winding machine conveys tube support members 1 from the winding machine through a tube removal station 59 at which tubes 3 are removed from the posts 2 of the tube support members and placed in a container 60. The empty tube support members 1 are fed by the conveyor 57,58 from the winding machine to an inlet conveyor 15 that runs along the ends of and feeds tube support members to the plurality of accumulating devices or conveyors 9, 10, 11, 12, 13 and 14, from which tube support members are discharged onto an outlet conveyor 8 and fed to a conveyor 8' that conveys the tube support members past a loading station 43 at which full bobbins 4 are manually loaded from a supply container 44 onto the posts 2 of empty tube support members that are conveyed through the loading station 43. The conveyor 8' leading to the winding machine conveys tube support members with full bobbins thereon to the winding machine. Intermediate the loading station 43 and the winding machine, and extending from the winding machine feeding conveyor 8' to the conveyor 57,58 leading from the winding machine is an overflow conveyor 52 that conveys loaded tube support members in excess of those being demanded by the winding station back to the conveyor 57,58 to the accumulating devices 9, 10, 11, 12, 13 and 14 for later discharge and feeding to the winding machine, with the accumulating devices 9–14 also serving to accumulate empty tube support members 1 until a sufficient number have been accumulated to warrant the performance of a loading operation, at which time the empty tube support members 1 are discharged from the accumulating devices 9–14 for ultimate travel past the loading station at which full bobbins are loaded onto the tube support members 1.

To direct movement of the tube support members 1 around and within the transport system, a series of diverting gates are provided at various locations. The gates are pivotable arm members which are movable between a diverting position in which the arms are placed in a conveyor path to intervene in the movement of tube support members 1 and a non-diverting position in which the arms are clear of the conveyor path. Also disposed throughout the transport system are a series of detectors which can recognize the presence of tube support members 1 passing thereby. These detectors may be photodetectors, microswitches or any other suitable device.

As will be explained in greater detail hereinafter, certain portions of the conveyors are defined as tube support member retaining segments. Tube support member retaining gates are also disposed at various locations to define the outlet of such segments and the aforesaid detectors are disposed to define the inlet to the segment. The tube support member retaining gates are arm members which are movable between a retaining position wherein the arm member is extended across the lateral extent of a conveyor to retain the tube support members 1 and a retracted position wherein the arm does not interfere with tube support member 1 movement therepast.

Operation of all gates and conveyor belt movements is responsive to signals emitted from a conventional central control device 74 which is preferably a microprocessor. The central control device 74 also receives electronic signals from the detectors as well as positional information from the gates to direct the tube support member movement around the transport system according to a predetermined program.

Also disposed within the system are a conventional yarn remnant scanner 61, a conventional tube doffer 59, a conventional yarn end preparing device 66, and a conventional tube stripper 65. All are in communication with the central control device 74 and signals received thereby can cause the central control device 74 to actuate various gates and/or belt movements in response thereto.

The remnant scanner 61 is disposed along an upstream segment 57 of the conveyor from the outlet of the textile winder and actuates a diverting gate 62 adjacent the outlet of the textile winder in such a way that the gate 62 allows only tube support members 1 carrying empty tubes 3 to pass thereby so that only tube support members 1 with empty tubes 3 reach the tube doffer 59. Only empty tube support members 1 then leave the doffer 59 to be conveyed along the downstream segment 58 of the conveyor.

The downstream conveyor segment path 58 opens into a common inlet conveyor 15 communicating with six accumulating devices or conveyors 9–14 at their respective inlets. The inlet conveyor 15 is oriented to be perpendicular to the accumulating paths 9–14 and the conveyor segment 58 and includes a non-actuable curved guide plate 40 disposed at its inlet for diverting a moving tube support member from the conveyor segment 58 thereonto. Five diverting gates 35–39, which are actuable by the central control device 74, are disposed along the inlet path 15 for diverting tube support members 1 into a selected accumulating conveyor 9–14.

Detectors 28–33 are disposed at the inlet of each of the accumulating conveyors 9–14 and each is in communication with the central control device 74. The detectors 28–33 respond to the passage of a tube support member 1 and electronically communicate that information to the central control device 74. Six tube support member retaining gates 16–21 are disposed at the outlets of the accumulating conveyors 9–14 and communicate with the central control device 74 for retaining or releasing the accumulated tube support members 1 responsive to signals therefrom. Six detectors 22–27 are disposed adjacent the tube support member retaining gates 16–21, communicate with the central control device 74 and emit an electronic signal thereto in response to both the arrival of the first tube support member 1 on a previously empty accumulating conveyor 9–14 and the exit of the last tube support member after the accumulating conveyors 9–14 have been emptied. This evacuation is done either in response to a relatively long time interval after the passage of a tube support member 1 as determined by an internal timer function within the central control device 74, or by counting the tube support members passing by the detector, the number of tube support members accumulated in any given accumulating conveyor being retained in memory by the central control device 74. However, by counting the tube support members 1, a predetermined number, less than all, of tube support members 1 may be selectively released. This accumulating conveyor may then be refilled, and the central control device 74 may begin to count tube support members entering that conveyor responsive to signals from the detector disposed at the inlet thereof. In this way, the number of tube support members retained by each of the accumulating conveyors 9–14 can be monitored continuously.

Figure 2:
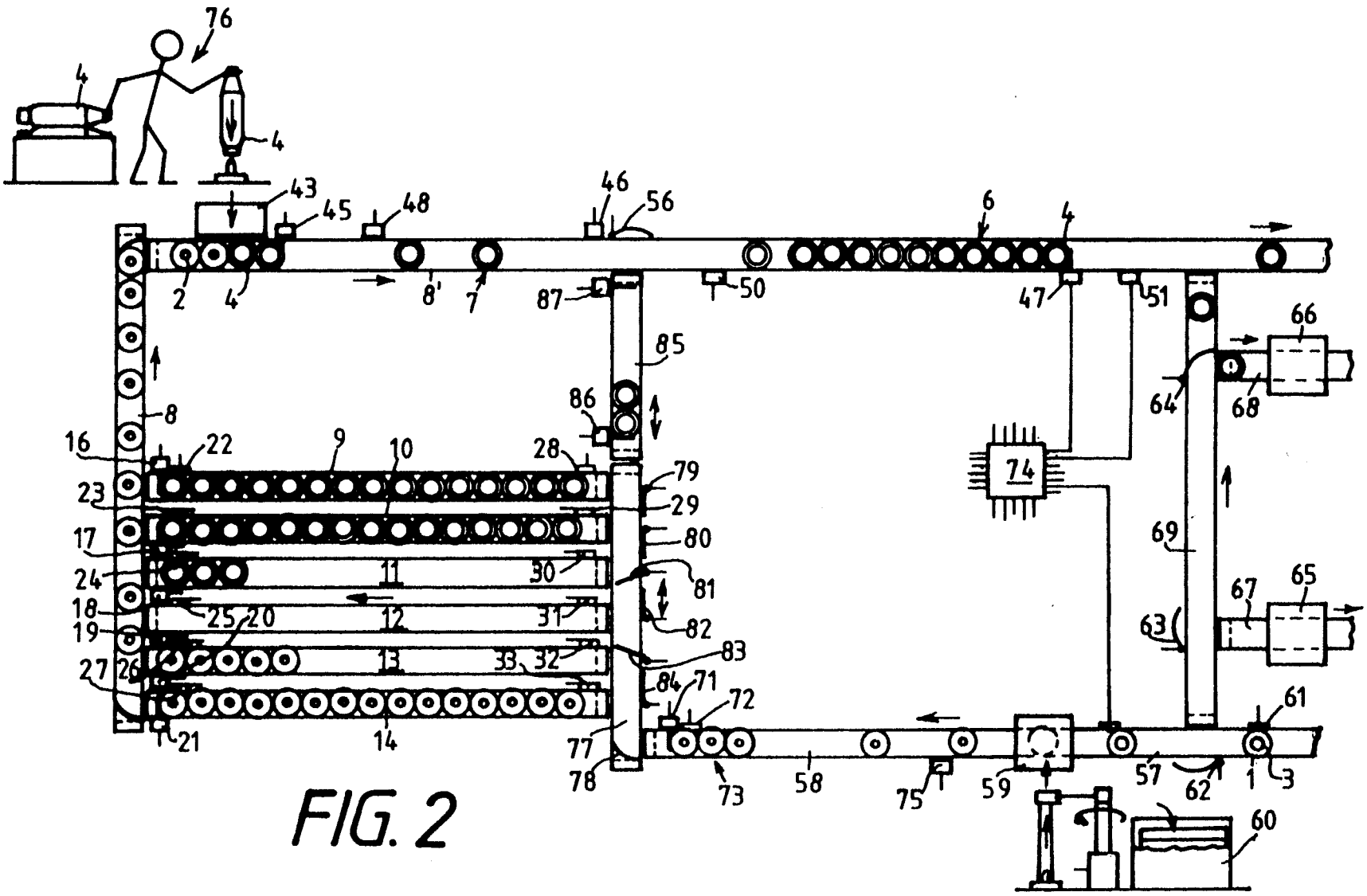
FIG. 2 is a schematic top plan view of a transport system incorporating an accumulating apparatus according to a second preferred embodiment of the present invention.

The accumulating conveyors 9–14 discharge onto a common outlet conveyor 8, which is disposed adjacent the outlets of the accumulating conveyors 9–14. The outlet conveyor 8 is oriented in a spaced parallel relation with the inlet conveyor 15 with the accumulating conveyors 9–14 extending perpendicularly therebetween. The conveyor 8' for delivery of tube support members to the winder is disposed adjacent the outlet of the outlet path 8, is oriented perpendicularly thereto and extends to form a bobbin delivery segment 5. Guide members 41 and 42 are disposed on the common outlet conveyor 8 connected to the outlet side to divert the tube support members 1 from the outer accumulating conveyor 14 onto the outlet conveyor 8 and to divert all tube support members from the outlet conveyor 8 onto the delivery conveyor 8'. A bobbin loading station 43 is disposed along the delivery conveyor 8' adjacent the inlet thereof. As seen in FIG. 2, an operator 76 loads full bobbins 4 onto the tube support members 1 from a container 44 (FIG. 1) adjacent the bobbin loading station 43. A second tube support member retaining segment 7 is defined along the delivery path 8' downstream of the loading station 43 with a tube support member retaining gate 46 disposed a predetermined distance downstream of the loading station 43 to define the outlet of the segment 7. The second tube support member retaining segment 7 can be monitored to determine its fill state by means of two detectors 48,49 disposed adjacent the inlet and the outlet thereof communicating with the central control device 74 for counting the tube support members 1 with bobbins 4 that have been transported thereby.

Farther downstream, a first tube support member retaining segment 6 defined by a tube support member retaining gate 47 disposed a predetermined distance downstream of the second tube support member retaining segment 7. A detector 50 is disposed to define the inlet to this second segment 7. The bobbin tube requirements of the winder at any given time are met by releasing tube support members with full bobbins thereon from the first tube support member retaining segment 6 for travel along the delivery segment 5 to the winding machine. As already explained, a yarn remnant scanner 61 communicates with a diverting gate 62 downstream therefrom using the central control device 74. If the remnant scanner 61 has detected a remnant of wound yarn large enough for processing through the winder, the diverting gate 62 is pivoted across the tube return conveyor 57, diverting the tube support member 1 that carries the remnant bobbin tube to a connecting conveyor 69 extending perpendicularly between the conveyor 57 and the bobbin delivery segment 5. Another diverting gate 64 along the connecting conveyor 69 is additionally actuated and diverts this tube support member 1 from the connecting conveyor 69 to a branch conveyor 68, along which a yarn end preparing device 66, which is especially suited to finding the ends of the yarn on remnant bobbin tubes, is disposed.

If the remnant scanner 61 detects a small yarn remnant that would not be worth returning to the winding station, then the gate 62 diverts the tube support member 1 to the connecting path 69, and another diverting gate 63 is actuated, which diverts this tube support member 1 to another branch path 67, along which a tube stripper 65 is disposed. This circulation of tubes having remnant yarn thereon is known and does not form a part of the present invention except for its advantageous use in the same system.

One possible alternative to using a yarn end preparing device 66 is that if the remnant scanner 61 has detected a remnant bobbin tube or a rejected bobbin tube on which the beginning of the yarn could not be delivered to the winding station, this bobbin tube can be carried beyond the diverting gate 62 into the connecting conveyor 69 toward the tube doffer 59, which must also be triggered, so that it does not remove this remnant bobbin tube or rejected bobbin tube from the tube support member 1 carrying it. The tube support member 1 with the remnant bobbin tube or rejected bobbin tube with its full package is then transported onto the same accumulating conveyor on which it would be transported if it were an empty tube support member 1. This remnant bobbin tube or rejected bobbin tube will then be delivered to the operator at the bobbin loading station 43, who, instead of loading a new bobbin, will look for the end of the yarn and place it in such a way that the normal yarn end preparing device disposed in the bobbin winder can engage this end of the yarn and place it appropriately. It may also be possible, by counting the tube support members as described, to monitor their progress and route them to a predetermined accumulating conveyor.

Referring again to FIG. 1, the empty tube support members 1, in which the post 2 can be seen, are delivered from the tube doffer 59, past the inlet 53 of the overflow conveyor 52, to a third tube support member retaining segment 73 disposed intermediate the outlet of the overflow conveyor 52 and the inlet to the inlet conveyor 15. There is a tube support member retaining gate 71 disposed at the upstream end of this tube support member retaining segment 73 which communicates with the central control device 74. A detector 72 disposed next to the tube support member retaining gate 71 also monitors the passage of the tube support members through this point, while another detector 72' is provided for monitoring the fill state of the third tube support member retaining segment 73 with respect to the empty tube support members 1. An additional tube support member retaining gate 71' is disposed intermediate the outlet of the overflow path 52 and the tube doffer 59 such that the third tube support member retaining segment 73 is defined by the location of the tube support member retaining gates 71,71'.

The accumulating conveyors 9–14 are arranged in a series and the inlet conveyor 15 can selectively pass tube support members 1 to each conveyor in the series. The control device 74 directs the diverting gates 34–39 to fill the accumulating conveyors 9–14 with bobbins 4 disposed on tube support members 1 sequentially from one side of the series and to fill the accumulating conveyors with empty tube support members from the other side of the series. The accumulating conveyors that contain tube support members 1 with bobbin tubes are emptied as the bobbin tubes 4 are delivered to the bobbin winder, while other accumulating conveyors are being filled with empty tube support members 1. For controlling the accumulating conveyors 9–14, it is provided that there is always one empty accumulating conveyor between the accumulating conveyors that carry tube support members with bobbins and the accumulating conveyors that carry empty tube support members.

Successively filling and emptying the accumulating paths causes this empty accumulating conveyor location to migrate continuously from one end of the accumulating apparatus to the other. For example, in FIG. 1, the third accumulating path 11 has just released the tube support members 1 carrying bobbin tubes 4, which are transported to the second tube support member retaining segment 7. This just emptied accumulating path 11 will be the next empty accumulating path, while the diverting gate 37 disposed along the inlet conveyor 15 adjacent the inlet of the fourth accumulating conveyor 12 is adjusted to divert empty tube support members 1 discharged from the third tube support member retaining segment 73 thereinto. The diverting gate 37 then remains open until such time as the fourth accumulating conveyor 12 is filled, which is determined by a detector 31 disposed at the inlet of the fourth accumulating conveyor 12 for counting the empty tube support members 1 that have entered the fourth accumulating conveyor 12. Next, the diverting gate 37 is opened to allow tube support members 1 to pass thereby. To fill the first accumulating path 9, a non-moving diverting plate 34 is provided adjacent the inlet to the first accumulating conveyor 9, because the tube support members 1 arriving there will always have to be diverted thereto. Another non-moving diverting plate 40 is provided for diverting the tube support members from the conveyor segment 58 to the inlet conveyor 15.

The tube support members 1 with bobbin tubes 4 that have been discharged from the third accumulating conveyor 11 and delivered to the second tube support member retaining segment 7 are backed up there and are available for delivery to the first tube support member retaining segment 6 located downstream. Downstream of the tube support member retaining gate 47, defining the upstream end of the first tube support member retaining segment 6, a detector 51 for counting the bobbin tubes 4 that were released by the tube support member retaining gate 47 and delivered to the bobbin winder is disposed. Like all other detectors associated with the present invention, this detector 51 is communicated with the central control device 74.

As is fundamentally necessary in textile winders, the bobbin tubes are allocated to meet the demand of the textile winder. Again as is conventional, this demand is measured at the outlet of the bobbin winder by the number of empty tubes passing by a detector 70 disposed adjacent the outlet of the textile winder. After one or more tubes 3 have passed the detector 70 along the tube conveyor 57, the central control device 74 opens the tube support member retaining gate 47 at the end of the first tube support member retaining segment 6. If the detector 51 disposed at the inlet of the textile winder has ascertained the needed number of bobbin tubes 3, the associated tube support member retaining gate 47 is closed again. If the time delay should have allowed a larger number of bobbin tubes 3 to pass the detector 51 at the inlet to the winder than the number of empty tubes discharged, this number is taken into account in the central control device 74, which subtracts it from the number of subsequently discharged bobbin tubes 3. In this way, the number of bobbin tubes 3 in direct bobbin winder circulation is maintained constant.

When the operator is loading bobbins 4 on the tube support members 1 after the first retaining segment 6 has been filled, the tube support members being loaded are diverted to the accumulating conveyors 9–14 through the overflow conveyor 52 by actuation of a diverting gate 56 disposed at the downstream end of the second retaining segment 7 adjacent the entrance to the overflow path 52. Filling of the overflow conveyor 52 is monitored by the detector 55 disposed on the inlet end of the overflow conveyor 52, which communicates with the central control device 74. If a predetermined number of support members 1 are retained along the overflow path 52 and this number corresponds to the capacity of one accumulating path 9–14, for instance, then the tube support member retaining gate 54 can be opened provided the third tube support member retaining segment 73 is empty. This requires that the tube support member retaining gate 71 be opened beforehand, in order to release the retained empty tube support members 1 from the third tube support member retaining segment 73. Moreover, the tube support member retaining gate 71' downstream from the tube doffer 59 and upstream of the overflow conveyor 52 must be closed as well, so that no empty tube support members 1 mix in with the tube support members 1 having bobbins 4 thereon that are delivered from the overflow path 52. The control of this tube support member retaining segment 73 is controlled by the detectors 72,72', which monitor the fill state of the third tube support member retaining segment 73.

Once the empty tube support members 1 released from the tube support member retaining segment 73 have reached their intended accumulating conveyor 9–14 as determined by the relevant detectors 28–33, the gates 35–39 disposed along the inlet conveyor 15 must be reset accordingly, so that tube support members 1 loaded with bobbin tubes 4 can enter a different predetermined accumulating conveyor.

Referring to the transport condition illustrated in FIG. 2, empty tube support members 1 are delivered from the fifth accumulating conveyor 13 to the loading station 43. To initiate loading, the operator must issue a suitable instruction to the central control device 74, which then switches over to the bobbin loading mode. The operator 76 in the loading position 43 can also actuate a tube support member retaining gate 45 disposed adjacent the loading station, for stopping the tube support members 1 to be loaded with bobbins. However, the possibility also exists of automatically opening this tube support member retaining gate 45 in increments after the bobbin loading mode has been initiated, so that the operator 76 does not need to attend to anything other than loading the bobbins 4 on the tube support members furnished. It is also advantageous if the bobbin loading station 43 includes a defined region of the transport conveyor 8', so that the operator can always reach the bobbin supply container 44 during the process of loading.

Particularly if the textile winder is a machine that processes so-called large bobbin tubes, for example, those on which rug yarns are wound, the process time in the winding station is relatively long in comparison with the time associated with processing small bobbins. Thus the period of time for loading a bobbin 4 onto a tube support member 1 is substantially shorter than the cycling time for the bobbin in the winder. This makes it possible within the framework of one bobbin loading cycle to fill the accumulating conveyors 9–14 completely with full bobbins (except for the accumulating path 9–14 that remains empty, as previously discussed). In this way, given suitable accumulation capacity, the operator need only load bobbins periodically and need not return to the winder for loading bobbins for a relatively long time.

In the loading phase illustrated in FIG. 2, the first tube support member retaining segment 6 is illustrated as being partially filled and near capacity. If the detector 50 at the inlet of the first tube support member retaining segment 6 does not detect the presence of a loaded tube support member 1 after a predetermined period of time, then the tube support members 1 with full loaded bobbin tubes are initially still delivered to the first tube support member retaining segment 6. Then, once the detector 50 has detected that the first tube support member retaining segment 6 is filled, the tube support member retaining gate 46 is closed by the central control device 74, after which the second tube support member retaining segment 7 is filled, until the detector 48 upstream at the end of the second tube support member retaining segment 7 determines that it is full as well. The tube support member retaining gate 46 at the outlet of the second tube support member retaining segment 7 is thereupon opened and simultaneously the diverting gate 56 is actuated to direct the tube support members 1 released by the tube support member retaining gate 46 to the overflow conveyor 85. As distinguished from the first preferred embodiment, the second preferred embodiment includes an overflow conveyor 85 that is substantially shorter than that illustrated in FIG. 1. This overflow conveyor 85 extends intermediate the transport conveyor 8' and the inlet conveyor 77, providing two inlets thereto as will be described in greater detail hereinafter. The inlet of the overflow conveyor 85 is monitored by a detector 87, which counts the tube support members 1 entering the overflow conveyor 85. A tube support member retaining gate 86 is disposed at the downstream end of the overflow conveyor 85, allowing the overflow path to function as a tube support member retaining segment, albeit one that is relatively short.

Since the overflow conveyor 85 and the conveyor 58 from the winder discharge at different ends into the inlet conveyor 77, the conveyor belt of the inlet conveyor 77 must be reversibly driven. Correspondingly, diverting gates 79–84 disposed at the inlets to the accumulating conveyors 9–14 can also be moved between two different functional positions depending on the direction from which support members arrive. Accordingly, these particular diverting gates are movable between three positions, two of which divert support members 1 from opposite entry directions. This is illustrated in FIG. 2 by the third and fifth diverting gates 81,83, respectively. The third diverting gate 81 is shown as being configured to allow tube support members 1 that arrive from the overflow conveyor 85 to be transported into the third accumulating conveyor 11, if the conveyor belt of the inlet conveyor 77 is moving in the direction from the overflow path 85 to the third tube support member retaining segment 73. The fifth diverting gate 83 is effective in the opposite transport direction, when empty tube support members are to be discharged from the tube support member retaining segment 73 into the fifth accumulating conveyor 13. Reversing the drive direction of the conveyor belt of the inlet conveyor 77 is controlled by the central control device 74. Additionally, a non-actuable curved guide plate 78 is disposed at the inlet to the inlet conveyor 77 for diverting a moving tube support member 1 from the conveyor segment 58 thereonto. In this case as well, monitoring of the transport of the tube support members 1, each of which is counted by the corresponding detectors, is necessary. In principle, it must be assured that the tube support members 1 located on the inlet conveyor 77 must have entered onto the predetermined accumulating conveyor intended for them before the transport direction of the conveyor belt of the inlet conveyor 77 is reversed.

As before, the tube support member retaining segment 73 is monitored by a detector 75 disposed at its outlet. However, no further tube support member retaining gate is necessary, since the overflow path 85 does not discharge into the conveyor segment 58. As can also be seen from FIG. 2, it is also possible to only partially fill the accumulating paths 9–14.

Figure 3:
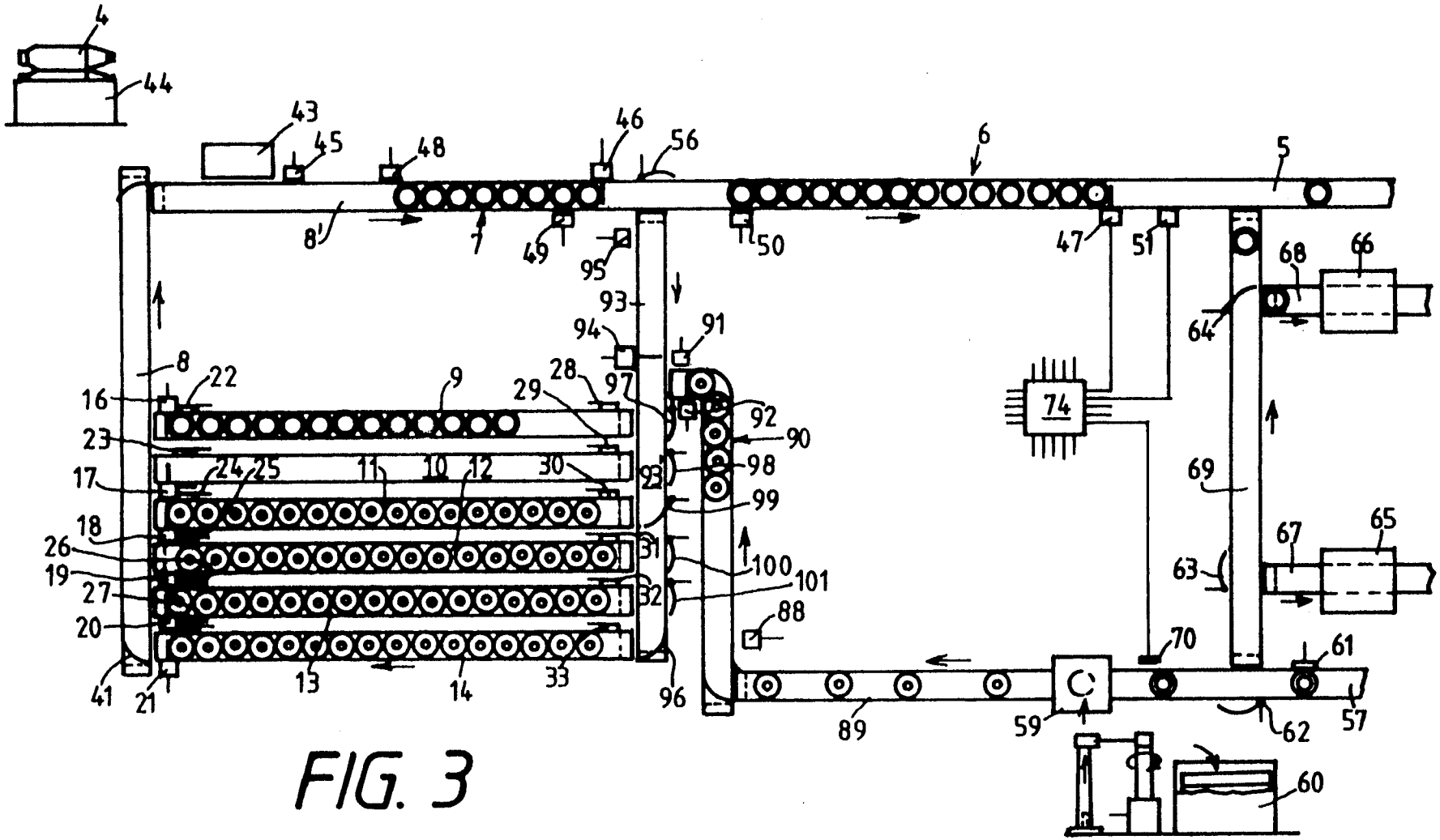
FIG. 3 is a schematic top plan view of a transport system incorporating an accumulating apparatus according to a third preferred embodiment of the present invention.

Referring now to FIG. 3, a third preferred embodiment of the accumulating apparatus of the transport system of the present invention is illustrated. This embodiment is distinguished by the transport conveyor 89 adjoining the conveyor 57 from the winder opening into an overflow conveyor 93 that merges with and is an integral extension of the inlet conveyor 93'. As a result of this altered conveyor routing as compared with the second preferred embodiment illustrated in FIG. 2, it is unnecessary to provide a reversing drive for the conveyor of the inlet conveyor 93'. Moreover, the diverting gates 97–101 are configured so that they have only one operating position each.

The overflow conveyor 93 has a tube support member retaining gate 94 upstream of the inlet to the inlet 93' to prevent tube support members 1 loaded with bobbins 4 from mixing with the empty tube support members 1. A detector 95 for monitoring the tube support members 1 entering the overflow conveyor 93 is disposed at the inlet thereof. A diverting gate 56, located within the transport system between the first and second tube support member retaining segments 6,7 is disposed at the inlet to the overflow path 93.

The operational mode shown in FIG. 3 illustrates a state in which it will soon become necessary for the operator to go to the bobbin loading station 43, in order to refill the accumulating apparatus with tube support members 1 that are loaded with bobbins 4. As illustrated in FIG. 3, the first and second tube support member retaining segments 6,7 are full, as determined by a detector 48 disposed upstream from the inlet to the overflow conveyor 93 and a detector 50 disposed downstream from the inlet to the overflow conveyor 93. However, the first accumulating conveyor 9 is only partly filled with tube support members 1 loaded with bobbins 4.

In this operational mode, it is advantageous if the central control device 74 actuates an alarm to alert the operator. This should occur in sufficient time to assure the uninterrupted supply of bobbins 4 to the winder.

A tube support member retaining gate 92 and a detector 91 are disposed at the downstream end of the conveyor 89 adjacent the overflow conveyor 93. This tube support member retaining gate 92 is located at the outlet of a supplemental accumulation conveyor segment 90 of the conveyor 89. A non-actuable curved guide plate 96 is disposed at the inlet to the supplemental accumulation conveyor segment 90 for directing a moving tube support member 1 from the conveyor 89 thereonto. The supplemental accumulation segment 90 extends perpendicularly to the conveyor 89. Monitoring the fill state of the supplemental accumulation conveyor segment 90 is accomplished by a detector 88, which is disposed at a predetermined distance from the tube support member retaining gate 92 that corresponds to the desired number of tube support members to be accumulated on the supplemental accumulation segment 90.

In the region adjacent the delivery of bobbins to the winder, tube support members 1 loaded with bobbins 4 are released from the first tube support member retaining segment 6 responsive to the winder demand.

The detector 50 immediately downstream of the inlet to the overflow conveyor 93, under the influence of the central control device 74, requests tube support members with full bobbins 4 from the second tube support member retaining segment 7 in order to keep the first tube support member retaining segment 6 continuously filled. Once the detector 49 disposed adjacent the tube support member retaining gate 46, defining the outlet of the second tube support member retaining segment 7 has detected that the second tube support member retaining segment 7 is becoming empty, refilling of this second tube support member retaining segment 7 is accomplished by opening the tube support member retaining gate 16 at the outlet of the first accumulating conveyor 9. Refilling empty tube support members 1 from the supplemental accumulating conveyor 90 does not take place until the first accumulation conveyor 9 has been completely emptied, in order to assure that there will always be one empty accumulation conveyor 9–14. As a result, the first accumulation conveyor 9 is empty before bobbins 4 are loaded. Empty bobbins are then conveyed sequentially from the accumulating conveyors in sequence beginning with the third accumulating conveyor 11 through the sixth accumulating conveyor 14 while tube support members with full bobbins are conveyed through the overflow conveyor segment 93 to the accumulating conveyors in sequence beginning with the first accumulating conveyor 9.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A transport system for circulating bobbin tube support members from and to a textile winder, said transport system comprising:

(1) means for conveying bobbin tube support members from the textile winder;

(2) means for conveying bobbin tube support members to the textile winder; and (3) means for temporarily accumulating bobbin tube support members intermediate said means for conveying tube support members to and from the textile winder, said accumulating means including:

(a) inlet conveying means for receiving tube support members from said means for conveying bobbin tube support members from the textile winder;

(b) outlet conveying means for delivering tube support members to said means for conveying bobbin tube support members to the winder;

(c) a plurality of individual tube support member accumulating devices intermediate said inlet and outlet conveying means for selectively receiving support members from said inlet conveying means, accumulating tube support members thereon, and releasing the tube support members to said outlet conveying means; and (d) control means for selectively controlling the receipt and release of tube support members to and from said individual accumulating devices.

2. A transport system for circulating bobbin tube support members according to claim 1 wherein said control means directs support members having bobbin tubes disposed thereon and empty tube support members to different of said individual accumulating devices.

3. A transport system for circulating bobbin tube support members according to claim 1 wherein said control means includes a central control device and diverting means operable by said central control device and associated with each said accumulating device at said inlet conveying means and said outlet conveying means for controlling the receipt and discharge of the tube support members to and from said accumulating devices.

4. A transport system for circulating bobbin tube support members according to claim 3 wherein said diverting means includes a plurality of remotely actuable gates, said gates including gates disposed for diverting tube support members from said inlet conveying means to selected accumulating devices and gates disposed for selectively retaining tube support members on said accumulating devices or releasing tube support members from said accumulating devices to said outlet conveying means.

5. A transport system for circulating bobbin tube support members according to claim 3 and further comprising overflow conveying means disposed for receiving tube support members from said means for conveying tube support members to the textile winder and an overflow diverting gate disposed for diverting tube support members being conveyed on said means for conveying tube support members to the textile winder to said overflow conveying means, said overflow diverting gate being in communication with said central control device.

6. A transport system for circulating bobbin tube support members according to claim 5 wherein said overflow conveying means includes overflow detecting means for detecting tube support members diverted to said overflow conveying means and communicating with said central control device.

7. A transport system for circulating bobbin tube support members according to claim 6 wherein said overflow conveying means is disposed for delivering tube support members to said means for conveying tube support members from the textile winder.

8. A transport system for circulating bobbin tube support members according to claim 7 wherein said overflow conveying means includes an overflow retaining gate disposed for retaining tube support members on said overflow conveying means, said gate being in communication with said central control device and actuable in response to information received therefrom.

9. A transport system for circulating bobbin tube support members according to claim 8 and further comprising a tube doffer disposed along said means for conveying tube support members from the textile winder intermediate said textile winder and said overflow conveying means for removing bobbin tubes from said support members.

10. A transport system for circulating bobbin tube support members according to claim 7 and further comprising a retaining gate disposed along said means for conveying tube support members from the textile winder intermediate said inlet conveying means and said tube doffer for selectively retaining and releasing tube support members on said means for conveying tube support members from the textile winder.

11. A transport system for circulating bobbin tube support members according to claim 10 and further comprising detecting means for detecting tube support members retained or released by said retaining gate, said detecting means including a first detector being disposed along said means for conveying tube support members from the textile winder disposed adjacent said retaining gate and being intermediate said inlet conveying means and said overflow conveying means, and a second detector disposed intermediate said overflow conveying means and said tube doffer, each said detector being in communication with said central control device.

12. A transport system for circulating bobbin tube support members according to claim 11 wherein said overflow retaining gate and said retaining gate disposed along said means for conveying tube support members from the textile winder are each individually actuable by said central control device, the actuation of one of said gates acting to prevent the actuation of the other of said gates to prevent the mixing of tube support members received from said overflow conveying means and tube support members received from the textile winder.

13. A transport system for circulating bobbin tube support members according to claim 5 and further comprising a first retaining gate disposed along said means for conveying tube support members to the textile winder intermediate said overflow conveying means and the textile winder for selectively retaining and releasing tube support members on said means for conveying tube support members to the textile winder.

14. A transport system for circulating bobbin tube support members according to claim 12 and further comprising first detecting means disposed intermediate said first retaining gate and the textile winder for counting and detecting tube support members entering the textile winder and communicating with said central control device for actuating said first retaining gate responsive to said first detecting means detecting and said central control device counting a selective predetermined number of tube support members entering the textile winder.

15. A transport system for circulating bobbin tube support members according to claim 14 and further comprising first retainer detecting means for detecting tube support members retained by said first retaining gate and disposed intermediate said overflow conveying means and said first retaining gate, said detecting means being in communication with said central control device, and said diverting gate disposed at the inlet to said overflow conveying means being selectively actuable by said central control device to divert tube support members to said overflow conveying means in response to information from said first retaining gate that said first retaining gate is positioned for retaining tube support members and from said first retainer detecting means that the portion of said means for conveying tube support members to the textile winder intermediate said first retaining gate and said first retainer detecting means includes a predetermined maximum number of tube support members.

16. A transport system for circulating bobbin tube support members according to claim 15 and further comprising a second retaining gate disposed along said means for conveying tube support members to said textile winder intermediate said outlet conveying means and said overflow conveying means and actuable by said control means to selectively retain and release tube support members on said means for conveying tube support members to the bobbin winder in response to said overflow detecting means detecting and said central control device counting a selectively predetermined number of support members disposed on said overflow conveying means and said first retainer detecting means detecting a selectively predetermined number of support members contained intermediate said first retaining gate and said first retainer detecting means.

17. A transport system for circulating bobbin tube support members according to claim 16 and further comprising second retainer detecting means disposed along said means for conveying tube support members to the textile winder intermediate said overflow conveying means and said outlet conveying means for detecting tube support members retained and released by said second retaining gate, said second retainer detecting means being in communication with said central control device for controlling the actuation of said second retaining gate.

18. A transport system for circulating bobbin tube support members according to claim 5 wherein said overflow conveying means is disposed for releasing tube support members to said means for conveying tube support members from the textile winder intermediate the textile winder and said inlet conveying means.

19. A transport system for circulating bobbin tube support members according to claim 5 wherein said overflow conveying means is disposed at an end of and substantially aligned with said inlet conveying means and said overflow conveying means and said inlet conveying means are each individually selectively reversible for conveying movement of tube support members in either direction responsive to instructions from said central control device.

20. A transport system for circulating bobbin tube support members according to claim 5 wherein said overflow conveying means is operable for delivery of tube support members to and from said inlet conveying means.

21. A transport system for circulating bobbin tube support members according to claim 20 and further comprising an overflow retaining gate disposed for retaining tube support members on said overflow conveying means and a second retaining gate disposed for retaining tube support members on said means for conveying tube support members from the textile winder, each said retaining gate being in communication with and individually actuable by said central control device to selectively direct tube support members onto said inlet conveying means from either of said overflow conveying means and said means for conveying tube support members from the textile winder, said central control device actuating driving movement of said reversible inlet conveying means in a direction responsive to one of said retaining gates being open for movement of tube support members away therefrom.

22. A transport system for circulating bobbin tube support members according to claim 5 wherein said overflow conveying means is an extension of said inlet conveying means and includes an overflow retaining gate disposed therealong for selectively retaining and releasing tube support members and said means for conveying tube support members from the textile winder communicates with said inlet conveying means at a location adjacent said overflow conveying means.

23. A transport system for circulating bobbin tube support members according to claim 3 wherein said accumulating devices are arranged in a series and said inlet conveying means communicates with each said accumulating device in said series, said control means directs said diverting means to fill said accumulating devices with tube support members having bobbin tubes disposed thereon sequentially from one side of said series and to fill said accumulating devices with empty tube support members from the other side of said series.

24. A transport system for circulating bobbin tube support members according to claim 1 and further comprising a bobbin tube loading station disposed along said means for conveying tube support members to the textile winder intermediate said outlet conveying means and the textile winder at which bobbin tubes may be loaded onto empty tube support members being conveyed on said means for conveying bobbin tube support members to the winder.

25. A transport system for circulating bobbin tube support members according to claim 24 and further comprising a retaining gate disposed adjacent said loading station actuable to selectively retain tube support members at said loading station.

26. A transport system for circulating bobbin tube support members according to claim 1 wherein each said individual accumulating device is disposed for receiving tube support members from said inlet conveying means and said control means includes detecting means disposed for detecting tube support members received by each accumulating device from said inlet conveying means and released by each accumulating device to said outlet conveying means and communicating with said control means.

* * * * *